US011193397B2

(12) United States Patent
Chapman et al.

(10) Patent No.: US 11,193,397 B2
(45) Date of Patent: Dec. 7, 2021

(54) LASH ADJUSTER WITH BALL PLUNGER RETAINING FEATURE AND METHOD OF MAKING SAME

(71) Applicant: Eaton Intelligent Power Limited, Dublin (IE)

(72) Inventors: John Page Chapman, Richland, MI (US); Gary Lynn Janowiak, Saginaw, MI (US); Prasanna Kumar Gudaloor, Portage, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/108,072

(22) Filed: Dec. 1, 2020

(65) Prior Publication Data

US 2021/0079816 A1 Mar. 18, 2021

Related U.S. Application Data

(63) Continuation of application No. PCT/EP2019/025165, filed on May 31, 2019.

(51) Int. Cl.
*F01L 1/24* (2006.01)
*B21D 22/02* (2006.01)

(52) U.S. Cl.
CPC ..... *F01L 1/24* (2013.01); *B21D 22/02* (2013.01); *F01L 2303/00* (2020.05)

(58) Field of Classification Search
CPC ..... F01L 1/24; F01L 1/2405; F01L 1/2411; F01L 1/2422; F01L 1/46; F01L 2303/00
USPC ..... 123/90.43, 90.46, 90.55
See application file for complete search history.

(56) References Cited

U.S. PATENT DOCUMENTS 4,615,440 A * 10/1986 Downing ..... F01L 1/25 123/90.48
4,793,295 A * 12/1988 Downing ..... F01L 1/14 123/90.5
2016/0177790 A1* 6/2016 Gudaloor ..... F01L 1/20 123/90.52

FOREIGN PATENT DOCUMENTS

JP S6127907 U 2/1986
JP 2017082643 A 5/2017
WO 2015048475 A1 4/2015

OTHER PUBLICATIONS

International Search Report and Written Opinion for International Application No. PCT/EP2019/025165 dated Sep. 12, 2019.

* cited by examiner

*Primary Examiner* — Jorge L Leon, Jr.
(74) *Attorney, Agent, or Firm* — RMCK Law Group PLC

(57) ABSTRACT

A method of manufacturing a lash adjuster body for use in a lash adjuster assembly can include forming a lash adjuster body to an as-formed condition including an outer cylindrical surface, an inner cylindrical surface leading to a blind bore, an end surface and a leak down portion. The method can also include imparting a wear resistant surface layer to at least the leak down portion of the inner cylindrical surface using ferritic nitrocarburizing (FNC). The lash adjuster body is upset at the end surface thereby forming at least one overlap portion that overlaps an opening to the blind bore.

18 Claims, 8 Drawing Sheets

LASH ADJUSTER WITH BALL PLUNGER RETAINING FEATURE AND METHOD OF MAKING SAME

CROSS-REFERENCE TO RELATED APPLICATIONS

This application is a continuation of International Application No. PCT/EP2019/025165 filed May 31, 2019, which claims the benefit of Indian Provisional Application No. 201811020615 filed Jun. 1, 2018, the contents of which are incorporated herein by reference thereto. The disclosure of the above application is incorporated herein by reference.

FIELD

The present disclosure is directed to a hydraulic or mechanical lash adjuster and a method of manufacturing the same.

BACKGROUND

Hydraulic or mechanical lash adjusters for internal combustion engines have been in use for many years to eliminate clearance or lash between engine valve train components under varying operating conditions. Lash adjusters can maintain efficiency and reduce noise and wear in the valve train. In some examples, hydraulic lash adjusters can support the transfer of energy from the valve-actuating cam to the valves through hydraulic fluid trapped in a pressure chamber under the plunger.

The background description provided herein is for the purpose of generally presenting the context of the disclosure. Work of the presently named Inventors, to the extent it is described in this background section, as well as aspects of the description that may not otherwise qualify as prior art at the time of filing, are neither expressly nor impliedly admitted as prior art against the present disclosure.

SUMMARY

A method of manufacturing a lash adjuster body for use in a lash adjuster assembly can include forming a lash adjuster body to an as-formed condition including an outer cylindrical surface, an inner cylindrical surface leading to a blind bore, an end surface and a leak down portion. The method can also include imparting a wear resistant surface layer to at least the leak down portion of the inner cylindrical surface using ferritic nitrocarburizing (FNC). The lash adjuster body is upset at the end surface thereby forming at least one overlap portion that overlaps an opening to the blind bore.

According to additional features, a ball plunger is inserted into the lash adjuster body prior to the upsetting. The upsetting captures at least a portion of the ball plunger in the lash adjuster body. Upsetting the lash adjuster body further includes forming at least two overlap portions at the end surface. Forming at least two overlap portions includes forming diametrically opposed overlap portions around the end surface.

In other features, the method includes annealing the lash adjuster body to relieve stresses arising during the forming. The lash adjuster body is placed into a vacuum furnace. The wear resistant surface is imparted while the lash adjuster body is in the vacuum furnace. The forming can be further defined as forming a lash adjuster body with one of cold forming, stamping, drawing, metal injection molding, powdered metal sintering, and machining. Forming can be further defined as cold-forming the lash adjuster body to the as-formed condition having functional geometry. The preserving can then be further defined as preserving the functional geometry of the leak down portion in the as-formed condition during imparting of the wear resistant surface layer. The preserving can be further defined as preserving the functional geometry of the leak down portion in the as-formed condition after imparting of the wear resistant surface layer.

In other features, a hardness of the lash adjuster body is maintained below the wear resistant surface layer after the forming and during the imparting. Preserving can further include preserving the leak down portion of the inner cylindrical surface in the as-formed condition after imparting of the wear resistant surface layer. Preserving can further comprise preserving a majority of the inner cylindrical surface in the as-formed condition after imparting of the wear resistant surface layer. Preserving can further include preserving a majority of both of the outer cylindrical surface and the inner cylindrical surface in the as-formed condition after imparting of the wear resistant surface layer.

A lash adjuster body for use in a lash adjuster assembly can include an outer cylindrical surface, an inner cylindrical surface and a pair of diametrically opposed overlap portions. The inner cylindrical surface can have an end surface that leads to a leak down portion and a blind bore. At least the leak down portion of the inner cylindrical surface can include a wear resistant surface layer imparted with a sub-critical temperature process using ferritic nitrocarburizing (FNC). The leak down portion can be preserved in an as-formed condition existing prior to the imparting of the wear resistant surface layer. The pair of diametrically opposed overlap portions are formed at the end surface. The overlap portions overlap an opening to the blind bore.

In additional features, the inner cylindrical surface further comprises a plunger shelf and a notch positioned between the leak down portion and the plunger shelf.

A lash adjuster assembly can include a lash adjuster body, a pair of diametrically opposed overlap portions and a leak down plunger. The lash adjuster body can include an outer cylindrical surface, an inner cylindrical surface, an end surface, a leak down portion and a blind bore. At least the leak down portion of the inner cylindrical surface can include a wear resistant surface layer imparted with a sub-critical temperature process using ferritic nitrocarburizing (FNC). The leak down portion can be preserved in an as-formed condition existing prior to the imparting of the wear resistant surface layer. The pair of diametrically opposed overlap portions can be formed at the end surface. The overlap portions overlap an opening to the blind bore. The leak down plunger can be slidably received in the inner cylindrical surface against the leak down portion. The leak down plunger is at least partially retained in the lash adjuster body by the pair of diametrically opposed overlap portions.

According to additional features, a majority of the outer cylindrical surface and a majority of the inner cylindrical surface include the wear resistant surface layer. The majorities of the outer and inner cylindrical surfaces can be preserved in the as-formed condition existing prior to the imparting of the wear resistant surface layer. A majority of the inner cylindrical surface can include the wear resistant surface layer and a functional geometry of the majority of the inner cylindrical surface can be maintained in the as-formed condition existing prior to the imparting of the wear resistant surface layer.

BRIEF DESCRIPTION OF THE DRAWINGS

The present disclosure will become more fully understood from the detailed description and the accompanying drawings, wherein.

DETAILED DESCRIPTION

Figure 1:
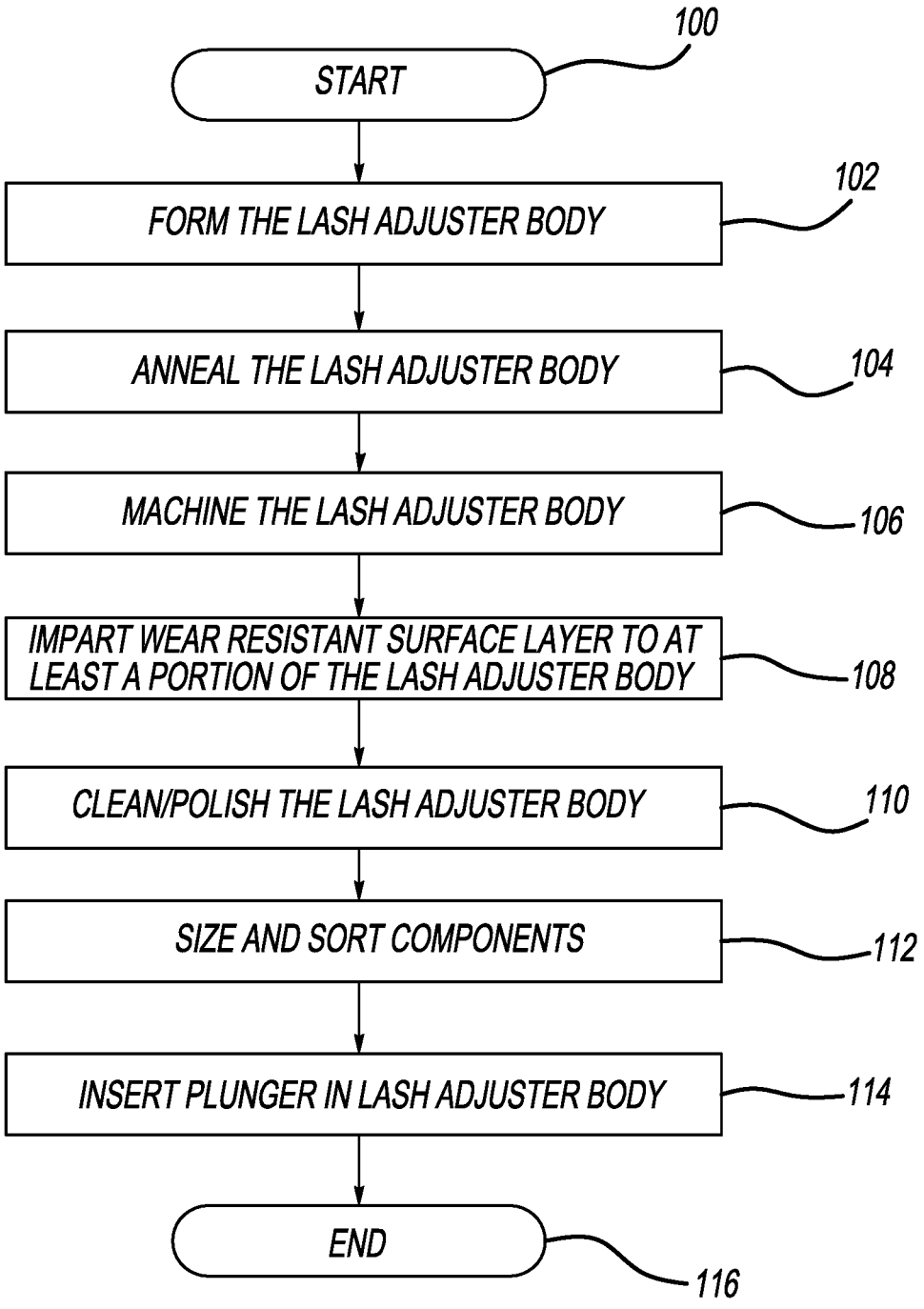
FIG. 1 is flow chart of a process in accordance with an example of the present disclosure.

A plurality of different embodiments of the present disclosure is shown in the Figures of the application. Similar features are shown in the various embodiments of the present disclosure. Similar features have been numbered with a common reference numeral and have been differentiated by an alphabetic suffix. Similar features across different embodiments have been numbered with a common reference numeral and have been differentiated by an alphabetic suffix. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

With reference now to FIG. 1, a method of manufacturing a lash adjuster body for use in a lash adjuster assembly can start at 100. At 102, a lash adjuster body can be formed to an as-formed condition. The as-formed condition can be defined as the lash adjuster body having functional geometry at the completion of 102. Functional geometry refers to the fact the lash adjuster body can be operable to perform upon being formed without further processing that would alter the geometry of the lash adjuster body.

Figure 2:
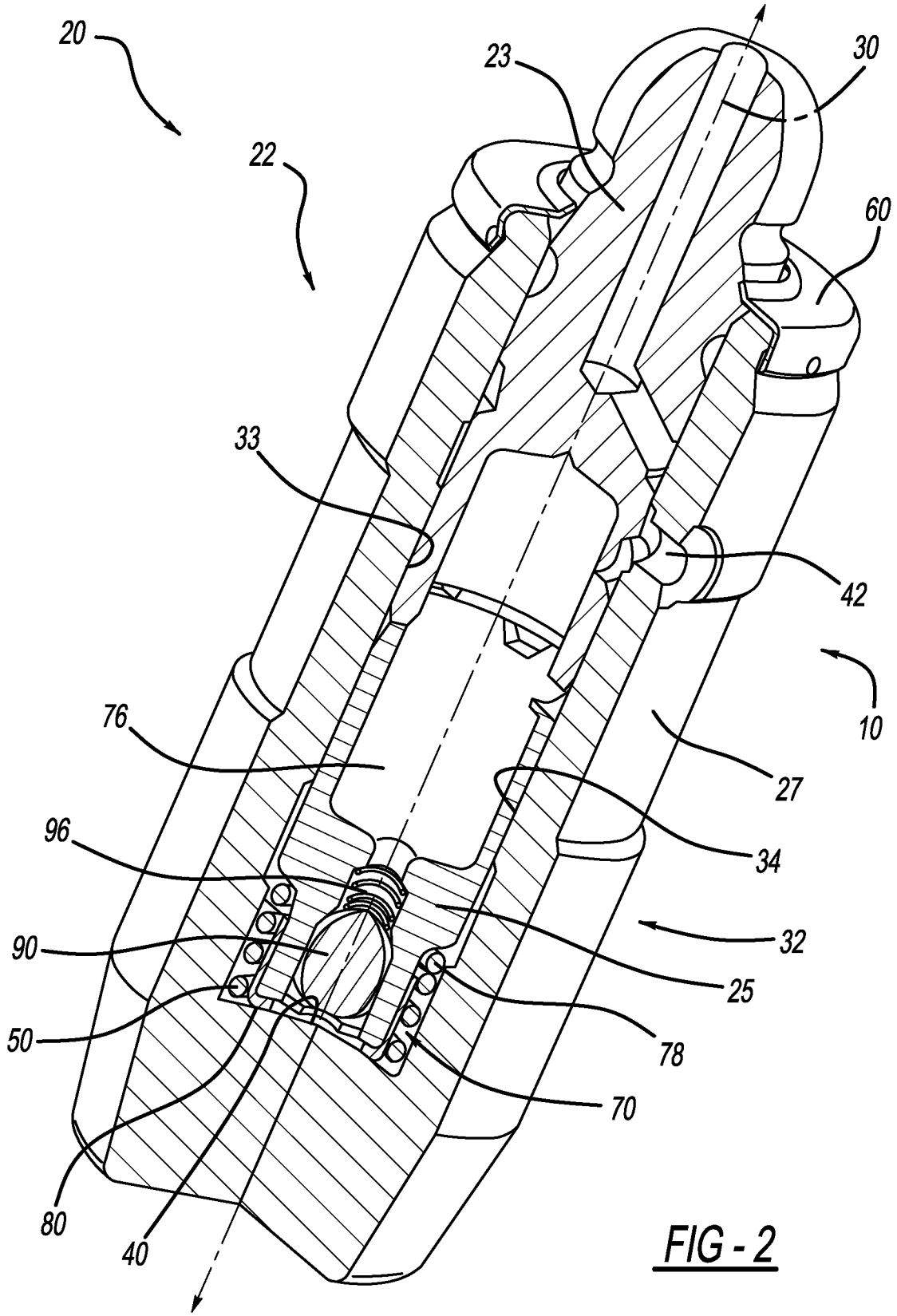
FIG. 2 is a cross-sectional view of a normally open lash adjuster constructed in accordance with another example of the present disclosure.

An exemplary lash adjuster body is referenced at 20 in FIG. 2. The lash adjuster body 20 can be formed using established metal forming and/or machining techniques with or without thermal input. Such technique could include cold-forming or cold-forging or cold-heading, deep-drawing cold formed in one or more embodiments of the present disclosure. Cold forming can be a relatively high-speed manufacturing process whereby metal is shaped at relatively lower temperatures. A cold-formed workpiece is not necessarily heated, but can increase in temperature during the cold forming process. Cold forming can be carried out without removing material from a workpiece. Metal can be forced beyond the elastic yield limit but below tensile strength. As used herein, the term "cold-forming" and its derivatives, are intended to encompass what is known in the art as "cold-forging", "cold heading" and "deep drawing". The lash adjuster body blank can be precision cold formed, wherein workpiece dimensions can be held to within microns. In some other embodiments, the lash adjuster body blank can be formed with stamping, drawing, metal injection molding, powdered metal sintering, or machining.

With reference now to FIG. 2, the lash adjuster body 20 can have an outer cylindrical surface 32 and an inner cylindrical surface 33. The inner cylindrical surface 33 can include a leak down portion 34 and a blind bore 40. The lash adjuster body 20 can be manufactured such that a majority of at least one of the outer cylindrical surface 32 and the inner cylindrical surface 33 is maintained in an as-formed condition. An unground condition can define one example of an as-formed condition. For example only, neither of the surfaces 32, 34 may be subjected to grinding in one or more embodiments of the present disclosure. Generally, grinding and machining are distinct subsets of metal removal generally. Grinding is a microscopic cutting operation and machining is a macroscopic cutting operation. Alternatively, at least one of the surfaces 32, 34 is not subjected to grinding in one or more embodiments of the present disclosure. Generally, if it is desired to grind the inner cylindrical surface 33, the outer cylindrical surface 32 must be ground as well since the lash adjuster body 20 will be held by the outer cylindrical surface 32 during grinding of the inner cylindrical surface 33. The exemplary lash adjuster body 20 of the present disclosure is thus not over-processed.

Referring again to FIG. 1, the lash adjuster body can be annealed at 104 in one or more embodiments of the present disclosure to reduce residual stresses. Processes for relieving stress alternative to annealing can be applied in some embodiments of the present disclosure. At 106, material can be machined from the lash adjuster body. A lash adjuster body can be machined by defining an aperture or by turning a groove in the outer cylindrical surface of the lash adjuster body, and by metal removal to qualify over-all length. As used herein, the term "machining" can mean the use of a chucking machine, drilling machine, turning machine, or broaching machine to remove material.

At 108, a wear resistant surface layer can be imparted to at least a portion of the lash adjuster body. The wear resistance of the portion of the lash adjuster body can be enhanced by 108. The wear resistant surface layer can be imparted to the outer cylindrical surface 32 and the inner cylindrical surface 33 in one or more embodiments of the present disclosure. Alternatively, the outer cylindrical surface 32 may or may not be imparted with a wear resistant surface layer. Any subcritical temperature process can be applied to impart the wear resistant surface layer, such as by way of example and not limitation ferritic nitrocarburizing (hereafter "FNC"), physical vapor deposition (hereafter "PVD"), or chemical vapor deposition (hereafter "CVD"). Other sub-critical temperature process can be applied as well. FNC is a thermochemical surface hardening process that includes diffusion of nitrogen and carbon onto the lash adjuster body. PVD is a process in which a solid coating material is evaporated by heat or by bombardment with ions on a workpiece to be coated. CVD is a process in which a workpiece is exposed to one or more volatile precursors which react and/or decompose on the workpiece to produce the desired coating. Such processes for imparting a wear resistant surface layer may be employed with or without a vacuum process to minimize or eliminate distortion.

It is noted that the order of 106 and 108 can be reversed in some embodiments of the present disclosure. In such an embodiment, the machining can include producing a side hole on the body, such as aperture 42. Alternatively, the machining could include creating an outer diameter groove such as groove 27. Alternatively, the machining could include creating the geometry for a hook portion such as hook portion 98*b* shown in FIG. 4. The machining operation could remove a portion of the wear resistant surface layer that was previously imparted to the lash adjuster body 20. Machining can also include material removal to correct the overall length of the lash adjuster body 20 and include lead-in angles or chamfers and/or radii on the inner and outer cylindrical surfaces.

According to prior art methods, the lash adjuster body would undergo a heat treatment process such as carbonitriding. Carbonitriding is a metallurgical surface modification technique that is used to increase surface hardness of a metal. Heat-treating the lash adjuster body with a process such as carbonitriding can cause the geometry of the lash adjuster body to be distorted. In such scenarios, a subsequent machining or grinding or material working step is necessary to return the lash adjuster body to its "pre-heat treated" shape or to an otherwise desired resultant shape. In the embodiments of the present disclosure, a conventional heat treatment step is replaced by incorporating a subcritical temperature process such as FNC or PVD or CVD that imparts a wear resistant surface layer and helps preserve the functional geometry of the lash adjuster body requiring no additional operations to correct distortion. Similar to increasing hardness as provided by carbonitriding, FNC enhances the wear resistance of a surface. In this regard, substantial time and cost savings may be realized by manufacturing the lash adjuster body according to the present method.

The functional geometry of the lash adjuster body is preserved as the wear resistant surface is being imparted. The lash adjuster body can thus be functionally operable after the imparting of the wear resistant surface. The wear resistant surface layer can have a depth of less than forty microns in some embodiments of the present disclosure. The wear resistant surface layer can have a depth of less than thirty microns in some embodiments of the present disclosure. The wear resistant surface layer can have a depth of less than twenty microns in some embodiments of the present disclosure. The wear resistant surface layer can have a depth of between ten and twenty microns in some embodiments of the present disclosure. The wear resistant surface layer can have a depth of between one and ten microns in some embodiments of the present disclosure.

At 110, the lash adjuster body can be subjected to cleaning and/or polishing. Cleaning and polishing could be carried out concurrently or sequentially. Any mechanical methods can be applied to re-establish the surface finish after a wear resistant surface layer is imparted. A plurality of lash adjuster bodies can be cleaned and polished at one time.

At 112, the lash adjuster body can be sized and sorted. The method discussed above can produce more repeatable lash adjuster bodies thereby reducing categories for size and sort operations. Explained further, because (i) the conventional heat treating step that can alter the geometry of the lash adjuster body and (ii) the subsequent machining (such as grinding) step that can further alter the geometry of the lash adjuster body are both eliminated, together less opportunities for the shape of the lash adjuster body to be distorted are presented. The geometries of the lash adjuster bodies are therefore more consistent. Inventory can be reduced. Capital cost can also be significantly reduced for processing the components.

Referring again to FIG. 2, a lash adjuster assembly constructed in accordance to one example of the present disclosure is shown and generally identified at reference number 10. The lash adjuster assembly 10 is of the Type 2 valve train variety. It will be appreciated, however, that the teachings discussed herein with regard to the lash adjuster assembly 10 can be used in any configuration of lash adjuster and is not limited to the configuration shown in FIG. 2. The lash adjuster assembly 10 can generally include a lash adjuster body 20 and a leak down and ball plunger combination 22. The leak down and ball plunger combination 22 can include a ball plunger 23 and a leak down plunger 25. The discussion above that focused on a method of forming the lash adjuster body 20 may also be applicable to other components of the lash adjuster assembly 10 including, but not limited to, the ball plunger 23 and/or the leak down plunger 25 of the leak down and ball plunger combination 22.

The lash adjuster body 20 can generally extend along a longitudinal body axis 30 and includes the outer cylindrical surface 32 and the inner cylindrical surface 33. The inner cylindrical surface 33 can define the blind bore 40. A fluid port 42 can be defined through the lash adjuster body 20.

The lash adjuster body 20 can be assembled with the remaining components of a lash adjuster assembly 10. The components can then be provided into a final lash adjuster assembly. Referring again to FIG. 2, the leak down plunger 25 and the ball plunger 23 can be inserted in the lash adjuster body 20 at 114. As shown in FIG. 2, the leak down plunger 25 can be received in the inner cylindrical surface 33 of the lash adjuster body 20. All or the majority of the inner cylindrical surface 33 can be preserved in an as-formed condition and the leak down plunger 25 can be slidably engaged with the majority of the inner cylindrical surface 33 during insertion. After assembly and in operation, the leak down plunger 25 can be slidably engaged with the leak down portion 34 of the inner cylindrical surface 33. In the exemplary lash adjuster body 20, the majority of the outer cylindrical surface 32 can also be preserved in an as-formed condition. The exemplary process can end at 116 in FIG. 1.

Referring again to FIG. 2, the leak down plunger 25 can be configured for reciprocal movement relative to the lash adjuster body 20 along the longitudinal body axis 30. This movement can be sliding movement of the outside surface of the leak down plunger 25 against the leak down portion 34 of the inner cylindrical surface 33. A plunger spring 50 can be disposed within the blind bore 40 underneath the leak down plunger 25 and be configured to bias the leak down plunger 25 in an upward direction (as viewed in FIG. 2) relative to the lash adjuster body 20. The plunger spring 50 can act at all times to elevate the leak down plunger 25 to maintain its engagement with the hemispherical concave surface (not shown) of a rocker arm (not shown). In the example shown, a retaining member 60 is provided adjacent an upper portion of the lash adjuster body 20. The retaining member 60 limits upward movement of the leak down plunger 25 relative to the lash adjuster body 20 and retains the leak down plunger 25 within the lash adjuster body 20.

The lash adjuster assembly 10 includes a check valve assembly 70 positioned between the plunger spring 50 and the leak down plunger 25 of the leak down and ball plunger combination 22. The check valve assembly 70 functions to either permit fluid communication or block fluid communication between a low-pressure fluid chamber 76 and a high-pressure fluid chamber 78 in response to pressure differential between the two fluid chambers 76 and 78. The check valve assembly 70 can include a retainer 80 that is in engagement with the leak down plunger 25 of the leak down and ball plunger combination 22, a check ball 90, and a check ball spring 96 that is disposed between the leak down plunger 25 and the check ball 90. The check ball spring 96 can be configured to bias the check ball 90 in a downward direction (as viewed in FIG. 2). The check valve assembly 70 can be referred to by those skilled in the art as "normally open."

Figure 3:
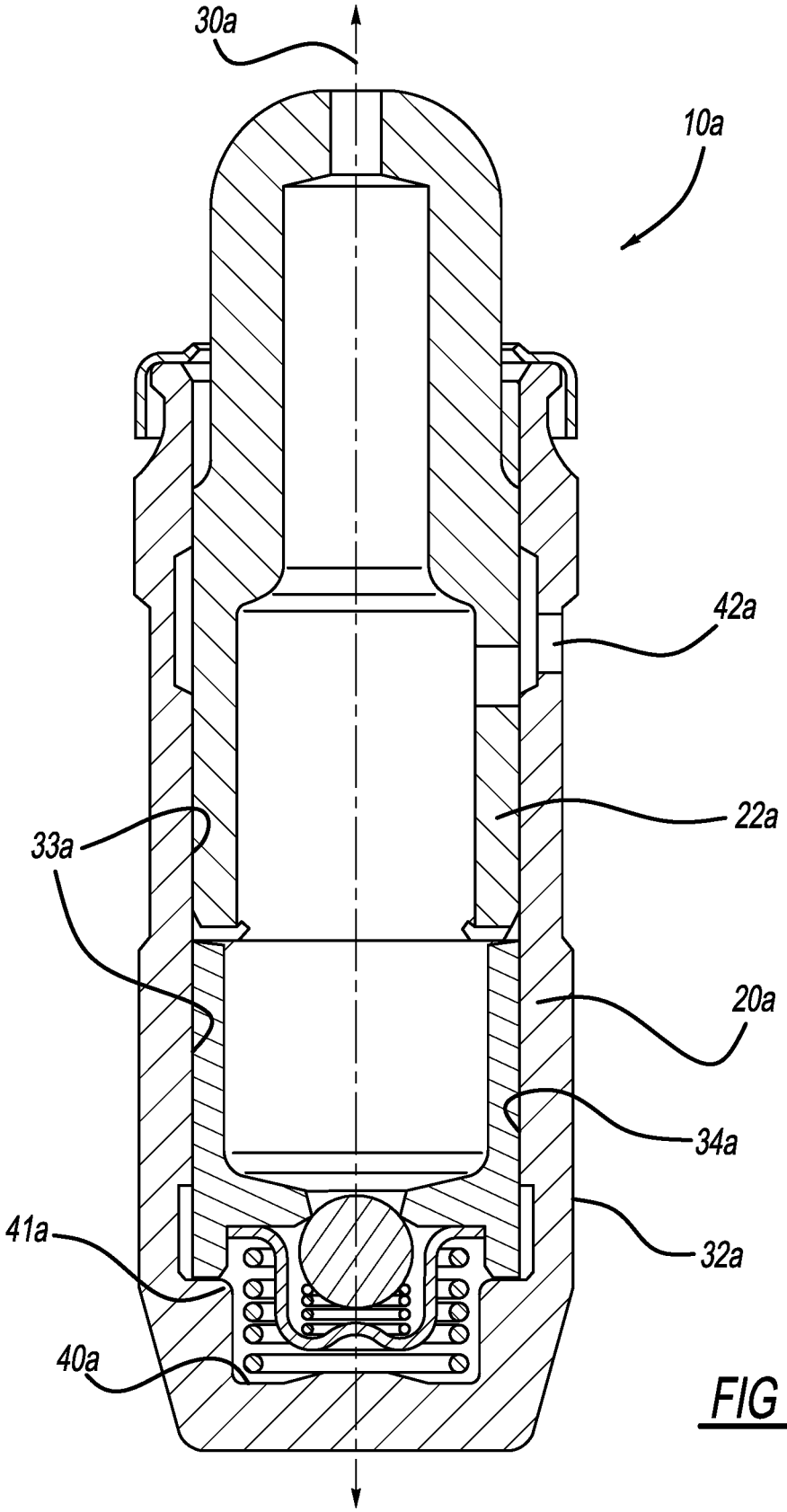
FIG. 3 is a cross-sectional view of a normally closed lash adjuster constructed in accordance with another example of the present disclosure.

With reference now to FIG. 3, a lash adjuster assembly constructed in accordance with another example of the present disclosure is shown and generally identified at reference number 10*a*. The lash adjuster assembly 10*a* can extend along an axis 30*a* and generally include a lash adjuster body 20*a* and a leak down and ball plunger combination 22*a*. An aperture 42*a* can be defined in the lash adjuster body 20*a*. The lash adjuster assembly 10*a* can comprise similar components as described above, but be configured as a normally closed lash adjuster. The lash adjuster body 20*a* can have an outer cylindrical surface 32*a* and an inner cylindrical surface 33*a*. The inner cylindrical surface 33*a* can include a leak down portion 34*a*, a blind bore 40*a*, and a plunger shelf 41*a*. The lash adjuster body 20*a* can be formed using the techniques described above. Specifically, the lash adjuster body 20*a* can be constructed using the method described above that avoids a heat treatment step and alternatively incorporates a process that imparts a wear resistant surface layer such as FNC, PVD, or CVD.

Figure 4:
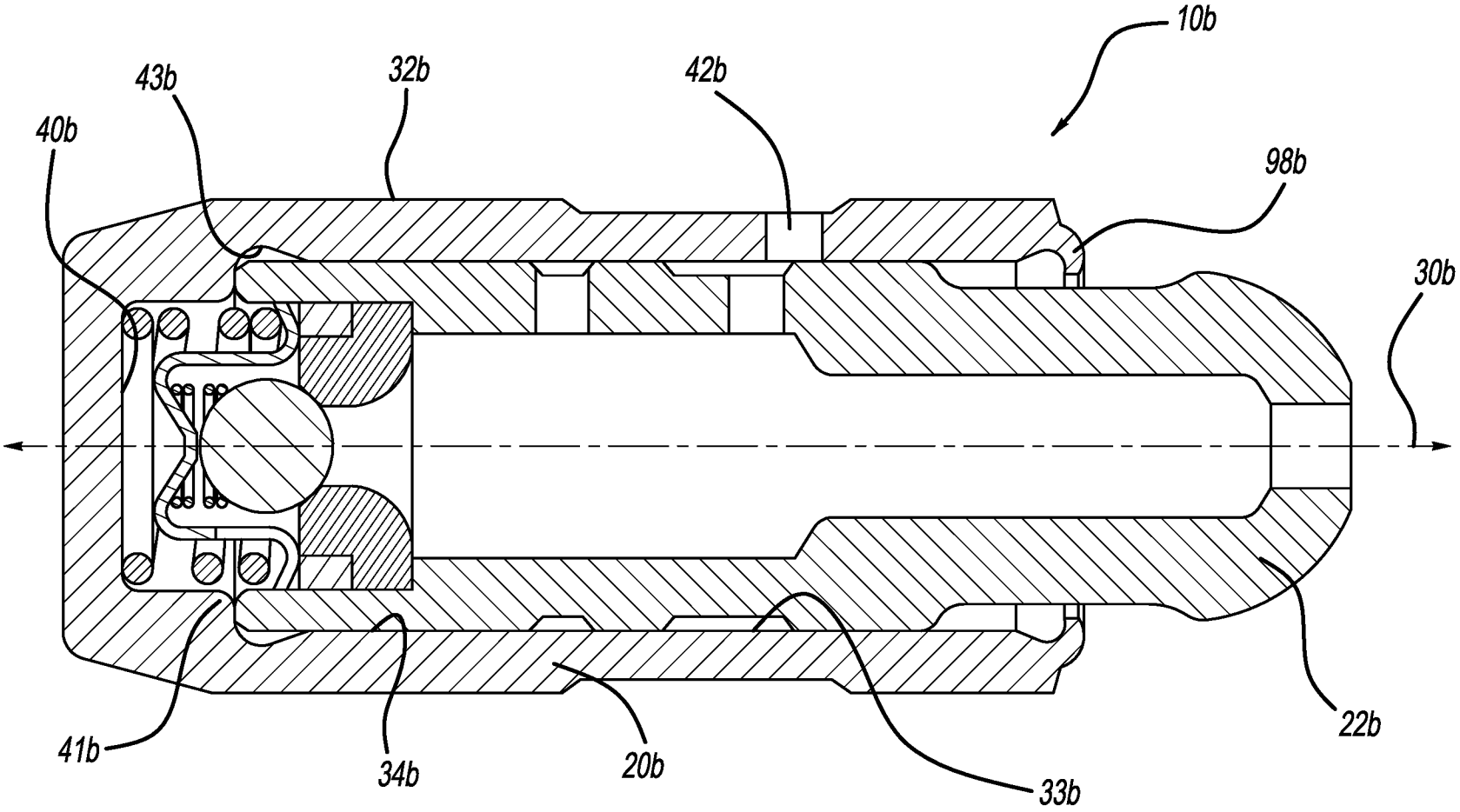
FIG. 4 is a cross-sectional view of a normally closed lash adjuster constructed in accordance with another example of the present disclosure.

FIG. 4 discloses another embodiment of the present disclosure. A lash adjuster assembly constructed in accordance with another example of the present disclosure is shown and generally identified at reference number 10*b*. The lash adjuster assembly 10*b* can extend along an axis 30*b* and generally include a lash adjuster body 20*b* and a leak down and ball plunger combination 22*b*. The lash adjuster body 20*b* can have an outer cylindrical surface 32*b* and an inner cylindrical surface 33*b*. The inner cylindrical surface 33*b* can include a leak down portion 34*b*, a blind bore 40*b*, and a plunger shelf 41*b*. The inner cylindrical surface 33*b* can further comprise a notch 43*b*. The notch 43*b* can be semi-obovate in cross-section and be positioned between the leak down portion 34*b* and the plunger shelf 41*b*. Notches of other shapes can be applied in other embodiments of the present disclosure. An aperture 42*b* can be defined in the lash adjuster body 20*b*. The lash adjuster assembly 10*b* can comprise similar components as described above, but be configured as a normally closed lash adjuster. The lash adjuster body 20*b* can be formed using the techniques described above. Specifically, the lash adjuster body 20*b* can be constructed using the method described above that avoids a heat treatment step and alternatively incorporates a subcritical temperature process that imparts a wear resistant surface layer such as FNC, PVD, or CVD.

The lash adjuster body 20*b* can define an inner diameter relief or hook portion 98*b*. The hook portion 98*b* can be created in the lash adjuster body 20*b* after a wear resistant surface layer is imparted. The wear resistant surface layer on the inside and/or outside of the hook portion 98*b* can be removed prior to crimping of the hook portion 98*b* to prevent fracture or breakage. The hook portion 98*b* can be crimped or deformed to provide retention of the leak down and ball plunger combination 22*b* within the lash adjuster assembly 10*b* and can eliminate the need for bottle-caps, wires and clips to retain the leak down and ball plunger combination 22*b*. Alternatively, the hook portion 98*b* of the body 20*b*, that is used for retention of the leak down and ball plunger combination 22*b*, can be used with conventional heat treatment of the lash adjuster body. In such application, the case or hard outer layers can be removed before crimping to prevent cracking or fracturing.

Figure 5:
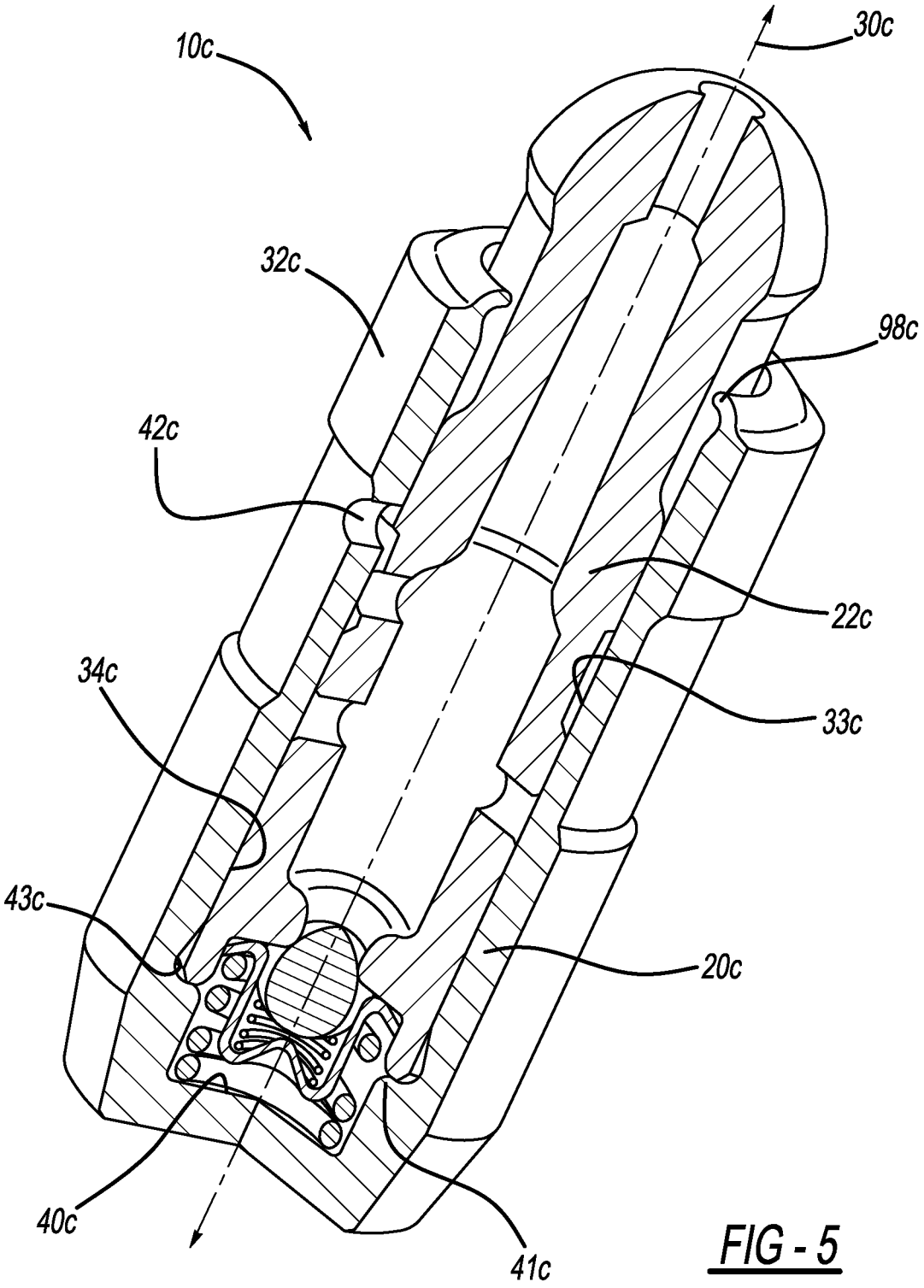
FIG. 5 is a variant cross-sectional view of a normally closed lash adjuster constructed in accordance with another example of the present disclosure.

FIG. 5 discloses another embodiment of the present disclosure, a variant of the embodiment shown in FIG. 4. A lash adjuster assembly constructed in accordance with another example of the present disclosure is shown and generally identified at reference number 10*c*. The lash adjuster assembly 10*c* can extend along an axis 30*c* and generally include a lash adjuster body 20*c* and a leak down and ball plunger combination 22*c*. The lash adjuster body 20*c* can have an outer cylindrical surface 32*c* and an inner cylindrical surface 33*c*. The inner cylindrical surface 33*c* can include a leak down portion 34*c*, a blind bore 40*c*, and a plunger shelf 41*c*. The inner cylindrical surface 33*c* can further comprise a notch 43*c*. The notch 43*c* can be semi-obovate in cross-section and be positioned between the leak down portion 34*c* and the plunger shelf 41*c*. Notches of other shapes can be applied in other embodiments of the present disclosure.

An aperture 42*c* can be defined in the lash adjuster body 20*c*. The lash adjuster assembly 10*c* can comprise similar components as described above, but be configured as a normally closed lash adjuster. The lash adjuster body 20*c* can be formed using the techniques described above. Specifically, the lash adjuster body 20*c* can be constructed using the method described above that avoids a heat treatment step and alternatively incorporates a subcritical temperature process that imparts a wear resistant surface layer such as FNC, PVD, or CVD. The lash adjuster body 20*c* can define an inner diameter relief or hook portion 98*c*. The hook portion 98*c* can be created in the lash adjuster body 20*c* after a wear resistant surface layer is imparted.

Figure 6:
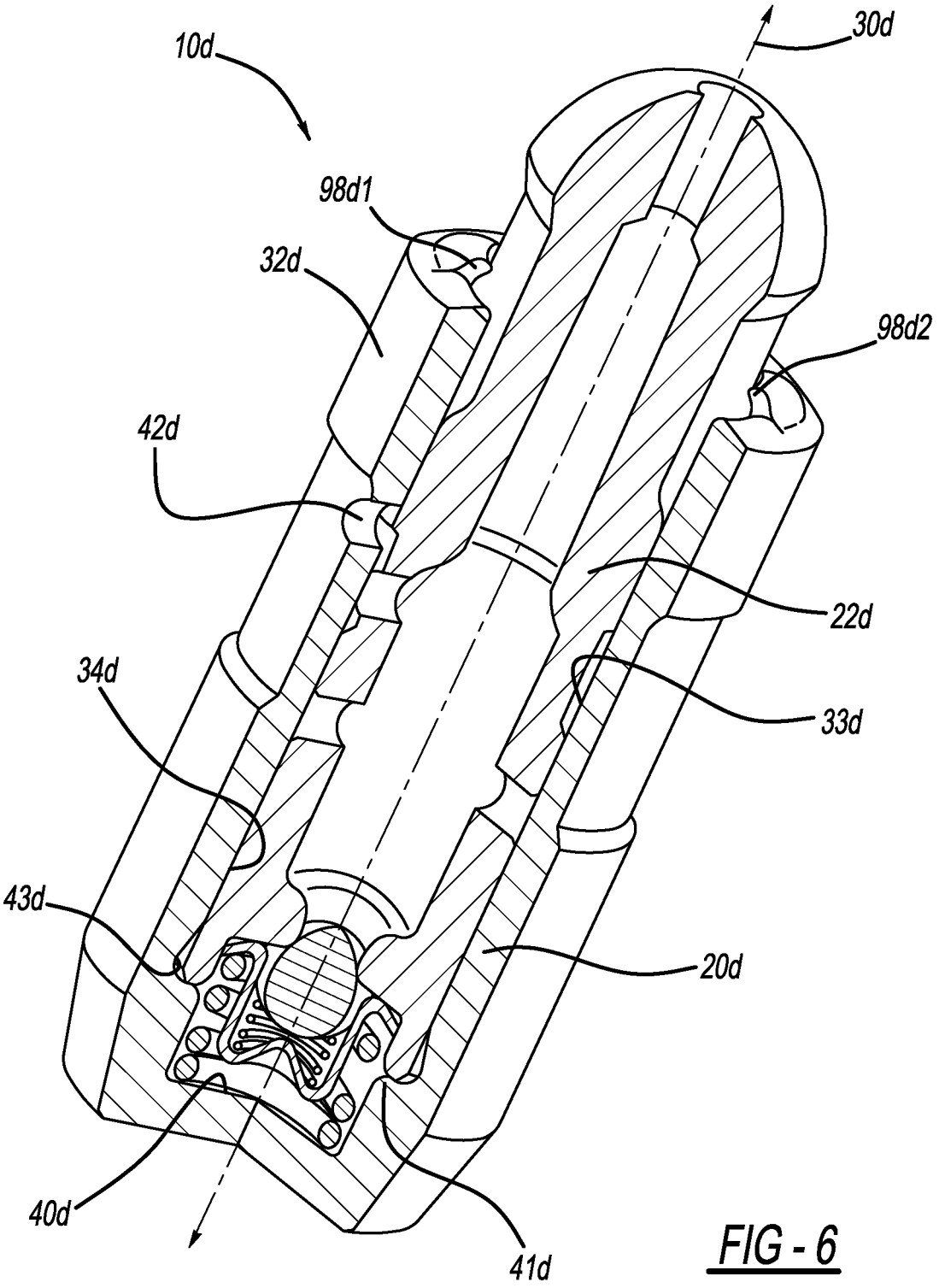
FIG. 6 is a cross-sectional view of a normally closed lash adjuster constructed in accordance with another example of the present disclosure.
Figure 8:
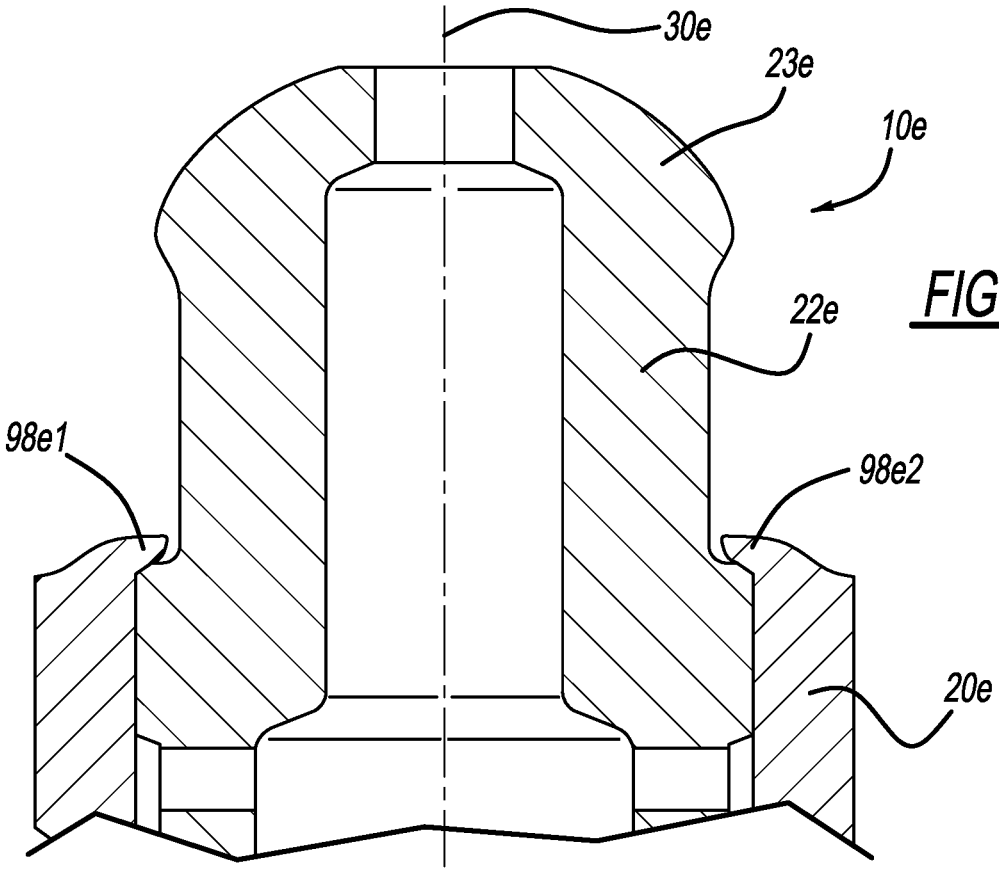
FIG. 8 is a partial cross-sectional view of a lash adjuster body constructed in accordance to additional features of the present disclosure.
Figure 9:
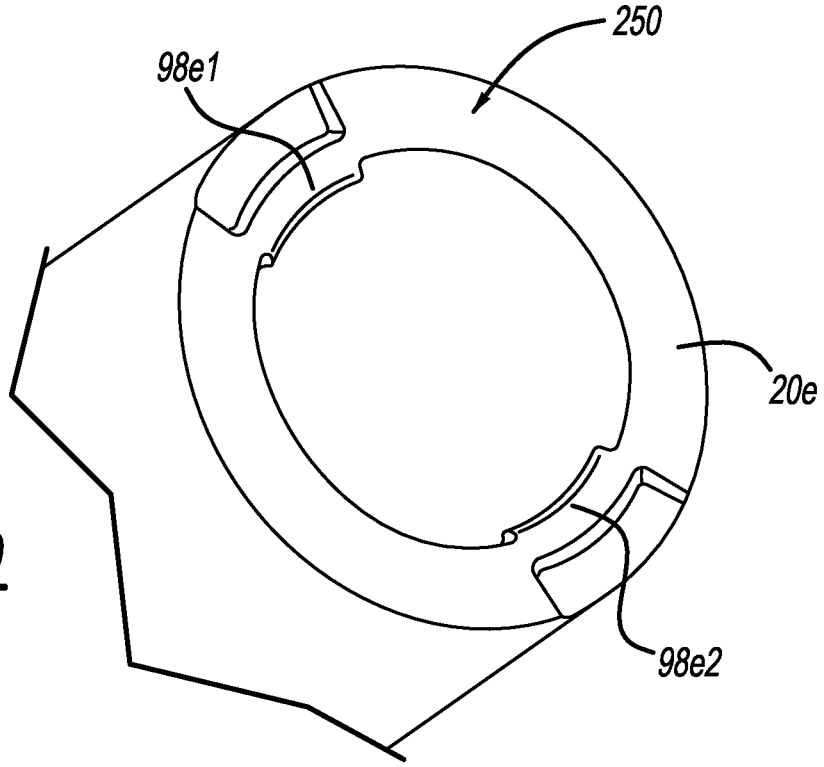
FIG. 9 is a partial perspective end view of the lash adjuster body of FIG. 8.

With additional reference now to FIG. 6, a lash adjuster assembly constructed in accordance to additional features of the present disclosure is shown and generally identified at reference 10*d*. The lash adjuster assembly 10*d* can extend along an axis 30*d* and generally include a lash adjuster body 20*d* and a leak down and ball plunger combination 22*d*. The lash adjuster body 20*d* can have an outer cylindrical surface 32*d* and an inner cylindrical surface 33*d*. The inner cylindrical surface 33*d* can include a leak down portion 34*d*, a blind bore 40*d*, and a plunger shelf 41*d*. The inner cylindrical surface 33*d* can further comprise a notch 43*d*. The notch 43*d* can be semi-obovate in cross-section and be positioned between the leak down portion 34*d* and the plunger shelf 41*d*. Notches of other shapes can be applied in other embodiments of the present disclosure. An aperture 42*d* can be defined in the lash adjuster body 20*d*. The lash adjuster assembly 10*d* can comprise similar components as described above, but be configured as a normally closed lash adjuster. The lash adjuster body 20*d* can include subsequently formed overlap portions 98*d*1 and 98*d*2. The overlap portions 98*d*1 and 98*d*2 can be created in the lash adjuster body 20*d* before or after a wear resistant surface layer is imparted. Additional details of the overlap portions are explained below with respect to overlap portions 98*e*1 and 98*e*2 (FIGS. 8 and 9). The overlap portions 98*e*1 and 98*e*2 function as a retaining feature.

The lash adjuster body 20*d* is formed exclusively with a subcritical temperature process that imparts a wear resistant surface using FNC. FNC will allow for many advantages over prior art including eliminating the need for grinding of the inner diameter. Also among the advantages of using FNC over other wear resistant surface layers (such as PVD) is that FNC does not need to be applied using line of sight. FNC is carried out in a vacuum furnace to apply the coating all over the surface of the adjuster body 10*d*. With FNC, an operator does not need line of sight to apply the coating, rather the nature of the vacuum furnace influences the coating to be applied from the atmosphere in the furnace all over the surface of the adjuster body 10*d*. In addition, FNC is performed at a low enough temperature to remain at a sub-critical temperature. In a sub-critical temperature range, distortion or shape change can be avoided as compared to other coating techniques that can occur beyond the sub-critical temperature (e.g. critical temperature). For comparison, PVD requires line of sight to apply the coating. In other words, the least accessible areas of the lash adjuster such as the leak down areas of the lash adjuster will require unattainable or very difficult line of sight for an operator to view and successfully apply the coating.

Figure 7:
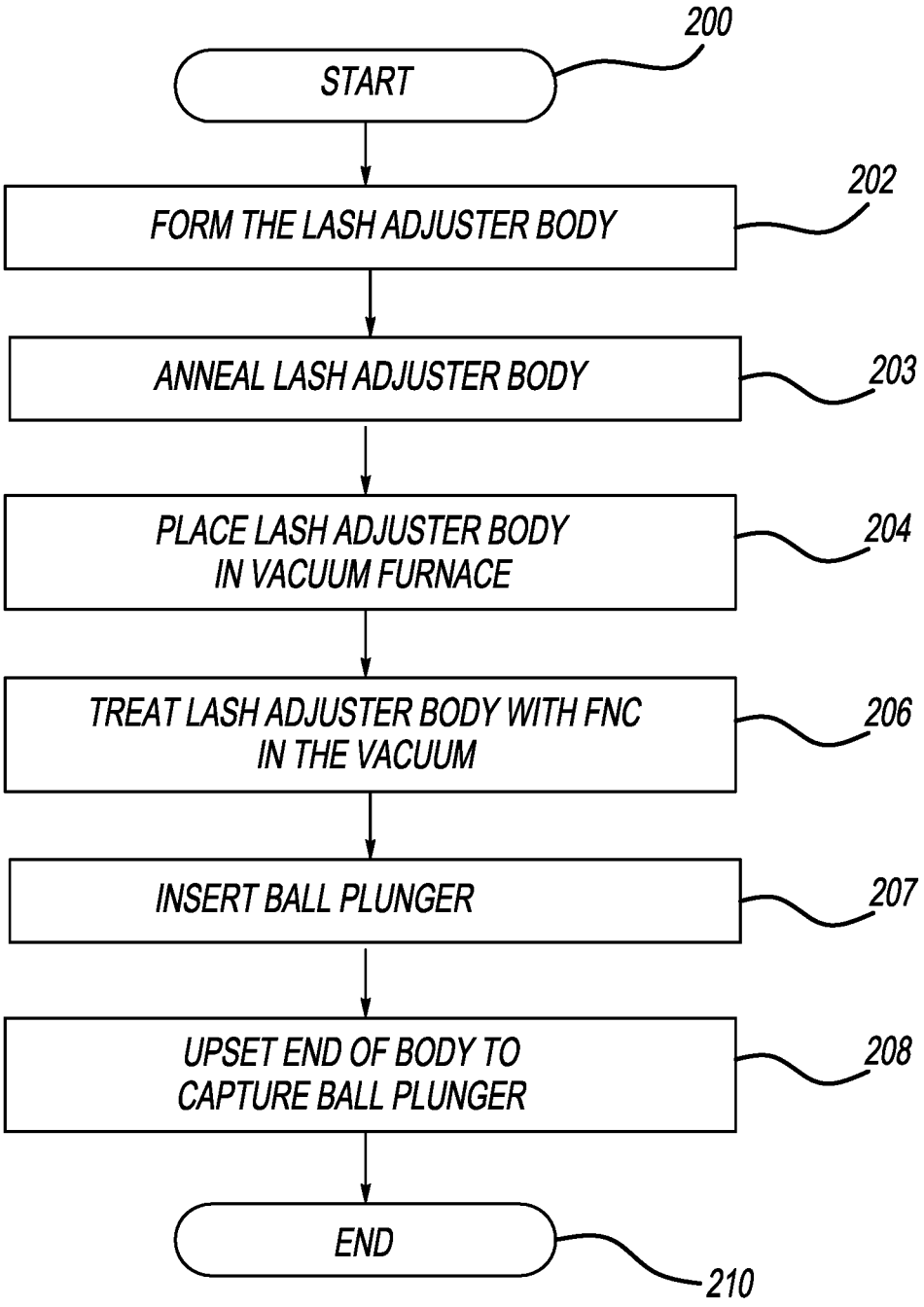
FIG. 7 is an exemplary method of manufacturing a lash adjuster body according to additional features of the present disclosure.

With reference now to FIGS. 7-9, a lash adjuster body 20*e* and related method for making according to additional features of the instant disclosure will be described. An example method of manufacturing a lash adjuster body according to additional examples of the present teachings is shown at FIG. 7. The method starts at 200. At 202, the lash adjuster body can be formed to an as-formed condition having functional geometry. For purposes of this discussion, the as-formed condition can be any lash adjuster geometry such as, but not limited to, the lash adjuster bodies 20*a*, 20*b*, 20*c* and 20*d* described above or the lash adjuster body 20*e* (FIGS. 8 and 9). The lash adjuster body is annealed at 203 to reduce residual stresses. At 204, the lash adjuster body can be placed into a vacuum furnace. At 206, the lash adjuster body can be treated with FNC in the vacuum furnace. The lash adjuster body now has a thin FNC coating over the cold formed body making the body as a whole easier to shape modify (critical for step 208 below). The ball plunger can be inserted into the lash adjuster body at step 207. At 208, the end of the lash adjuster body is upset (rolled over) to deflect material at an overlap to capture the ball plunger. By coating the lash adjuster body with an FNC layer, the deflection of material at the overlaps (see 98*e*1 and 98*e*2 below) can be successfully carried out. In a conventional case hardened lash adjuster, the material would be brittle making the deflection of material difficult to accomplish. In other words, material can tend to break or snap in a conventional case hardened lash adjuster when a material deflection step is attempted. The FNC layer makes the lash adjuster body stronger while still allowing the underlying material to be successfully worked (i.e., rolled over and/or deflected). The sequence of steps disclosed in FIG. 7 can eliminate the need for the retainer 60 shown in FIG. 2. The method ends at 210.

Turning now to FIGS. 8 and 9, a lash adjuster body 20*e* constructed in accordance to additional features will be described. Unless otherwise described herein, the lash adjuster body 20*e* can be constructed similar to the lash adjuster body 20*c* and 20*d* above and be used with a leak down and ball plunger combination 22*e* in a lash adjuster assembly 10*e*. The lash adjuster body 20*e* can include hook (overlap) portions 98*e*1 and 98*e*2. The overlap portions 98*e*1 and 98*e*2 are interrupted upsets formed around an end surface 250 of the lash adjuster body 20*e*. The overlap portions 98*e*1 and 98*e*2 are shown as diametrically opposed upsets. It will be appreciated however that a single upset, three upsets or more than three upsets may be formed at the end 250 for capturing the ball plunger 23*e* and leak down and ball plunger combination 22*e* in the lash adjuster body 20*e*. The overlap portions or upsets 98*e*1, 98*e*2 can be formed by a staking or a rolling step to displace material from the end 250 toward axis 30*e*. It is appreciated that the forming of the overlap portions 98*e*1 and 98*e*2 are carried out subsequent to positioning the leak down and ball plunger combination 22*e* in the lash adjuster body 20*e*.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of manufacturing a lash adjuster body for use in a lash adjuster assembly, the method comprising:

forming a lash adjuster body to an as-formed condition so as to include an outer cylindrical surface, an end surface, and a blind bore defining an inner cylindrical surface with a leak down portion;

imparting a wear resistant surface layer to at least the leak down portion using ferritic nitrocarburizing (FNC);

inserting a ball plunger into the blind bore; and upsetting the end surface so as to form at least two overlap portions that overlap an opening to the blind bore such that at least a portion of the ball plunger is captured within the lash adjuster body.

2. The method of claim 1, wherein the at least two overlap portions include diametrically opposed overlap portions.

3. The method of claim 1, further comprising annealing the lash adjuster body so as to relieve stresses arising during the forming of the lash adjuster body.

4. The method of claim 1, wherein the imparting of the wear resistant surface layer is conducted while the lash adjuster body is in a vacuum furnace.

5. The method of claim 4, wherein the forming of the lash adjuster body includes one of cold forming, stamping, drawing, metal injection molding, powdered metal sintering, and machining.

6. The method of claim 1, wherein the forming of the lash adjuster body includes cold-forming the lash adjuster body to the as-formed condition having a functional geometry.

7. The method of claim 6, further comprising:

preserving the functional geometry during the imparting of the wear resistant surface layer.

8. The method of claim 7, wherein the functional geometry is preserved after the imparting of the wear resistant surface layer.

9. The method of claim 1, further comprising:

maintaining a hardness of the lash adjuster body during the imparting of the wear resistant surface layer.

10. The method of claim 1, further comprising:

preserving the as-formed condition of the lash adjuster body after the imparting of the wear resistant surface layer.

11. The method of claim 1, further comprising:

preserving a majority of the inner cylindrical surface in an as-formed condition after the imparting of the wear resistant surface layer.

12. The method of claim 1, further comprising:

preserving a majority of the outer cylindrical surface in an as-formed condition after the imparting of the wear resistant surface layer.

13. The method of claim 1, further comprising:

preserving a majority of the outer cylindrical surface and the inner cylindrical surface in an as-formed condition after the imparting of the wear resistant surface layer.

14. A lash adjuster body for use in a lash adjuster assembly, the lash adjuster body comprising:

an outer cylindrical surface;

an end surface;

a blind bore formed in the end surface, the blind bore defining an inner cylindrical surface with a leak down portion, wherein at least the leak down portion includes a wear resistant outermost surface layer imparted with a sub-critical temperature process using ferritic nitrocarburizing (FNC) and the leak down portion is preserved in an as-formed condition existing prior to the imparting of the wear resistant outermost surface layer; and a pair of diametrically opposed overlap portions formed at the end surface so as to overlap an opening to the blind bore.

15. The lash adjuster body of claim 14, wherein the inner cylindrical surface further comprises a plunger shelf and a notch positioned between the leak down portion and the plunger shelf.

16. The lash adjuster assembly of claim 15, wherein the wear resistant outermost surface layer is further imparted to a majority of the outer cylindrical surface and a majority of the inner cylindrical surface so as to be preserved in an as-formed condition existing prior to the imparting of the wear resistant outermost surface layer.

17. A lash adjuster assembly comprising:

a lash adjuster body having an outer cylindrical surface, an end surface, and a blind bore defining an inner cylindrical surface with a leak down portion, wherein at least the leak down portion includes a wear resistant outer surface layer imparted with a sub-critical temperature process using ferritic nitrocarburizing (FNC) and the leak down portion is preserved in an as-formed condition existing prior to the imparting of the wear resistant outer surface layer;

a pair of diametrically opposed overlap portions formed at the end surface that so as to overlap an opening to the blind bore; and a leak down plunger slidably received in the blind bore against the leak down portion, the leak down plunger at least partially retained in the lash adjuster body via the pair of diametrically opposed overlap portions.

18. The lash adjuster assembly of claim 17, wherein the wear resistant outer surface layer is further imparted to a majority of the inner cylindrical surface such that a functional geometry of the majority of the inner cylindrical surface is maintained in an as-formed condition existing prior to the imparting of the wear resistant outer surface layer.

* * * * *